US007344446B2

(12) United States Patent
Wyeth

(10) Patent No.: US 7,344,446 B2
(45) Date of Patent: Mar. 18, 2008

(54) BALL DETECTION APPARATUS FOR DETECTING WHEN A GOLF BALL IS HIT OFF A GOLF TEE

(76) Inventor: Martin Wyeth, 42 North Street, Old Town, Swindon, Wiltshire (GB) SN1 3JY ( * ) Notice: Subject to any disclaimer, the term of this patent is extended or adjusted under 35 U.S.C. 154(b) by 471 days.

(21) Appl. No.: 10/799,647

(22) Filed: Mar. 15, 2004

(65) Prior Publication Data

US 2004/0192455 A1 Sep. 30, 2004

(30) Foreign Application Priority Data

Mar. 28, 2003 (GB) ..... 0307159

(51) Int. Cl.
*A63B 57/00* (2006.01)
*A63B 69/36* (2006.01)

(52) U.S. Cl. ..... 473/192; 473/132; 473/134; 473/136; 473/151; 473/190; 473/199

(58) Field of Classification Search ..... 473/134–136, 473/151, 192, 199; 463/36
See application file for complete search history.

(56) References Cited

U.S. PATENT DOCUMENTS

| | | | | |
|---|---|---|---|---|
| 5,246,232 | A | 9/1993 | Eccher et al. | |
| 5,269,519 | A * | 12/1993 | Malone | 473/154 |
| 5,282,629 | A * | 2/1994 | Eckstein | 473/133 |
| 5,338,036 | A * | 8/1994 | Takeuchi et al. | 473/209 |
| 5,375,832 | A | 12/1994 | Witler et al. | |
| 5,401,026 | A | 3/1995 | Eccher et al. | |
| 5,527,036 | A * | 6/1996 | Hutchings et al. | 473/220 |
| 5,529,307 | A | 6/1996 | Chang | |
| 5,603,664 | A * | 2/1997 | Provost | 473/134 |
| 5,674,130 | A | 10/1997 | Egan | |
| 6,149,532 | A | 11/2000 | Kim | |
| 6,179,720 | B1 | 1/2001 | Rankin et al. | |
| 6,293,802 | B1 * | 9/2001 | Ahlgren | 434/252 |
| 6,375,580 | B1 | 4/2002 | Schmidt et al. | |
| 6,456,232 | B1 | 9/2002 | Milnes et al. | |
| 2001/0023209 | A1 * | 9/2001 | Yamamoto | 473/407 |

FOREIGN PATENT DOCUMENTS

| | | | |
|---|---|---|---|
| JP | 06022319 | A * | 1/1994 |
| JP | 06311474 | A * | 11/1994 |

OTHER PUBLICATIONS

English translation of JP 06-022319 A—includes abstract, claims, description of drawings and detailed description.*
English translation of JP 06-311474 A—includes abstract, claims, description of drawings and detailed description.*

* cited by examiner

*Primary Examiner*—Robert Pezzuto
*Assistant Examiner*—Milap Shah
(74) *Attorney, Agent, or Firm*—Young & Thompson

(57) ABSTRACT

The ball detection apparatus is for detecting when a golf ball is hit off a golf tee of an automatic golf ball teeing machine. The detection apparatus comprises a radar device for producing a first signal in response to detecting movement of a golf club towards the tee, a directional microphone for producing a second signal in response to detecting the sound of a golf club striking a golf ball and monitoring means for detecting a coincidence between the first and second signals. An automatic golf ball teeing machine including such ball detection apparatus is also disclosed.

3 Claims, 1 Drawing Sheet

FIG 1
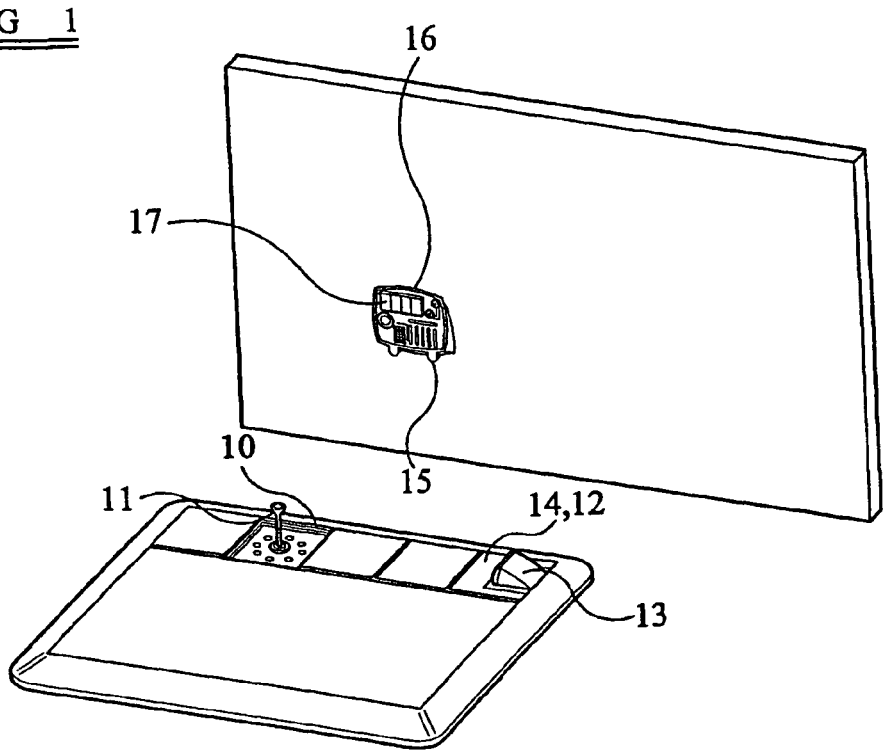
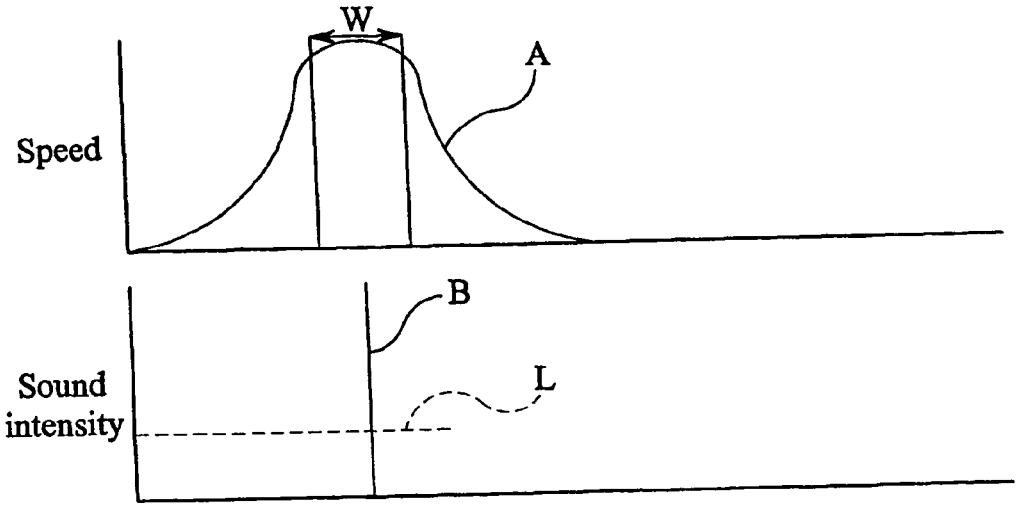
FIG 2

BALL DETECTION APPARATUS FOR DETECTING WHEN A GOLF BALL IS HIT OFF A GOLF TEE

This invention relates to ball detection apparatus for detecting when a golf ball is hit off a golf tee of an automatic golf ball teeing machine.

Automatic golf ball teeing machines are known and are in use at some golf driving ranges. They comprise a device for feeding balls onto a tee and means for detecting when a ball leaves the tee. The feeding device operates in response to the detecting means. The detecting means of these known teeing devices includes an air pump for pumping air through the tee and the detecting means relies on sensing a change in pressure when the ball leaves the tee.

Golf balls do not create a significant back pressure due to the surface pattern they possess and dirty balls can create even less back pressure. Therefore, a change in pressure is difficult to detect. Also, the present detectors are expensive to make as they require an air pump, a pressure sensor and a decoder and fail to detect the difference between a ball being hit from a tee and a ball falling off a tee.

It is also known to use arrangements which rely on weight detection to detect when a ball leaves the tee. However, these arrangements often malfunction as a result of mud or the like.

The present invention seeks to provide improved ball detection apparatus for an automatic golf ball teeing machine.

SUMMARY OF THE INVENTION

According to a first aspect of the invention there is provided ball detection apparatus for detecting when a golf ball is hit off a golf tee of an automatic golf ball teeing machine, comprising a radar device for producing a first signal in response to detecting movement of a golf club towards the tee, a directional microphone for producing a second signal in response to detecting the sound of a golf club striking a golf ball and monitoring means for detecting a coincidence between the first and second signals.

According to a second aspect of the present invention, there is provided an automatic golf ball teeing machine comprising ball detection apparatus according to the first aspect of the invention and a ball feeder for feeding balls one at a time to a golf tee, the ball feeder being operable in response to the monitoring means of the detection apparatus detecting a coincidence between the first and second signals.

The invention will now be more particularly described, by way of example, with reference to the accompanying drawings.

BRIEF DESCRIPTION OF THE DRAWINGS

FIG. 1 is a schematic perspective view of one embodiment of ball detection apparatus according to a first aspect of the invention incorporated in an automatic golf ball teeing machine, and FIG. 2 is a graph showing a coincidence between two signals produced by the ball detection apparatus shown in FIG. 1.

DESCRIPTION OF THE PREFERRED EMBODIMENT

Referring to FIG. 1 of the drawings, the automatic golf ball teeing machine shown therein comprises a ball feeder

10 for feeding balls one at a time to a golf tee. The ball feeder 10 includes a tee 11 and a mechanism (not shown) for delivering balls fed in through a ball inlet 12 of the feeder 10 one at a time to the tee. The ball feeder 10 as such is not the subject of this application but one example of such a ball feeder is disclosed In British Patent Application No. 0307162.8 of even date.

The automatic golf ball teeing machine also comprises ball detection apparatus for detecting when a golf ball is hit off the tee 11. The ball detection apparatus comprises a radar gun 13 housed in a hinged lid 14 of the ball inlet 12 and a directional microphone 15 supported by a control panel 16 located alongside the ball feeder 10. The radar gun 13 is aimed towards the path a golf club will take in hitting a ball from the tee 11 and is mounted on a transducer board (not shown).

The directional microphone 15 is aimed at the tee 11.

The ball detection apparatus also comprises monitoring means for detecting a coincidence between a first signal produced by the radar gun 13 and a second signal produced by the directional microphone 15 and, when certain criteria are met, for producing an output signal which is fed to the aforesaid mechanism of the ball feeder 10 so that a fresh golf ball is delivered to the tee 11.

Processing circuitry of the monitoring means is contained within the control panel 16. The microphone 15 is preferably responsive to sound within a frequency range of 2 to 5 KHz. This will filter out some background noise. The processing circuitry is arranged to product an output signal only if it detects a signal from the directional microphone 15 whilst a signal from the radar gun 13 is at or close to its peak level. This will be at a time when the golf club is travelling at maximum or near maximum speed. The processing circuitry is also arranged to only produce an output signal if it detects a coincidence between the signal from the radar gun 13 and a signal from the directional microphone 15 which is above a predetermined level. That level is varied in accordance with the amplitude of the signal from the radar gun 13 so that as the radar gun 13 detects a higher swing speed, the processing circuitry requires a higher intensity signal from the directional microphone 15 to produce an output signal. The logic behind this is that as a golf ball is hit harder the intensity of the sound of impact increases.

The control panel could also include a display 17 for displaying the maximum swing speed each time a ball is hit from the tee 11.

FIG. 2 is a graph showing a coincidence between a first signal A produced by the radar gun 13 and a second signal B produced by the directional microphone 15. The signal B falls within a window W of signal A indicative that the golf club is at or close to maximum swing speed and has a level greater than predetermined level L determined by the processing circuitry in accordance with the intensity of signal A. In these circumstances, the processing circuitry will output a signal to the ball feeder 10 which will operate in response to this output signal and will feed a new ball to the tee 11.

The embodiment described above is given by way of example only and various modifications may be apparent to persons skilled in the art without departing from the scope of the invention as defined by the appended claims.

What is claimed is:

1. Ball detection apparatus for detecting when a golf ball is hit off a golf tee of an automatic golf ball teeing machine, comprising a radar device which determines a swing speed of a golf club towards the tee and which produces a first signal corresponding to said swing speed, a directional microphone that produces a second signal in response to detecting the sound of said golf club striking a golf ball, and monitoring means for detecting a coincidence between the first and second signals, wherein the monitoring means is arranged to produce an output signal only if it detects a coincidence between the first and second signals and the second signal is above a predetermined level, and wherein the monitoring means varies said predetermined level in accordance with the amplitude of the first signal.

2. Ball detection apparatus as claimed in claim 1, wherein the microphone is responsive to sound with a frequency range of 2 to 5 KHz.

3. Ball detection apparatus as claimed in claim 1, wherein the monitoring means is arranged to produce an output signal only if it detects a second signal while the first signal is at or close to its peak level.

* * * * *